US006228005B1

(12) United States Patent
Gray

(10) Patent No.: US 6,228,005 B1
(45) Date of Patent: May 8, 2001

(54) MULTIPLE STATION EXERCISE AND STRETCHING APPARATUS

(76) Inventor: Gary W. Gray, 2701 Pfister Hwy., Adrian, MI (US) 49221

( * ) Notice: Subject to any disclaimer, the term of this patent is extended or adjusted under 35 U.S.C. 154(b) by 0 days.

(21) Appl. No.: 09/382,140

(22) Filed: Aug. 24, 1999

Related U.S. Application Data

(60) Provisional application No. 60/097,560, filed on Aug. 24, 1998.

(51) Int. Cl.[7] ..... A63B 23/02

(52) U.S. Cl. ..... 482/907; 482/148; 482/23

(58) Field of Search ..... 482/35, 901, 34, 482/36, 38, 41, 42; D21/811, 814, 826, 827

(56) References Cited

U.S. PATENT DOCUMENTS

| | | | | |
|---|---|---|---|---|
| 1,019,037 | * | 3/1912 | Garland | 482/35 |
| 1,142,137 | * | 6/1915 | Bathrick | 482/35 |
| 3,120,955 | * | 2/1964 | Darlin | 482/35 |
| 3,737,161 | * | 6/1973 | Taylor et al. | 482/35 |
| 4,538,807 | * | 9/1985 | Rice | 482/145 |

* cited by examiner

*Primary Examiner*—Jerome Donnelly
(74) *Attorney, Agent, or Firm*—Emch, Schaffer, Schaub & Porcello Co., L.P.A.

(57) ABSTRACT

A multiple station exercise and stretching apparatus is described. A first exercise station includes a plurality of spaced apart horizontal bars. A second exercise station includes a foot support and at least one horizontally extending grasping bar. A third exercise station includes at least one foot stirrup and at least one horizontally extending bar which is in a spaced apart relationship to the foot support. A fourth exercise station has an upper grasping member having bars which angle in a rearward and downward direction and at least one lower grasping device which is positioned at an angle to the upper grasping device. A fifth exercise station includes a plurality of vertically extending bars. A sixth exercise station includes a plurality of angled overhead bars. Each station preferably includes a support platform having a first angled mat which angles upwardly from a midline and a second angled mat which angles upwardly in an opposite direction from the first angled mat. The support platforms are spaced apart from and are in a generally perpendicular direction to the exercise stations such that a person stands on each support platform to use each exercise station.

10 Claims, 15 Drawing Sheets

10
12
13
14
15
16
18
20
22
30
32
32a
32b
32c
32d
32e
34
35
36
37
38
39
40
42
43
44

140
144
146
148
150
152
154
155
156
143
145
160
162
164
166
170
172
174
176
180
181
182
184
186
8

250
252
254
256
260
262
264
266
270
272
272a
272b
272g
274
276
278
280
282
286
290
292
294
296
44
253
255
258
265
286
a
b
c
d
e
f 370
364
366
396c
390
396a
396b
396d
396e
396f
376
375
363
8
374
365
382
368
396
395
394
386
384
385
380
372
360
362

450
452
454
456
460
462
464
465
466
470
472
474
474a
474b
474c
474e
474f
474g
474i
474j
474K
478
480
482
484
486
453
455
458
8

MULTIPLE STATION EXERCISE AND STRETCHING APPARATUS

This appln claims the benefit of Provisional No. 60/097,560 filed Aug. 24, 1998.

The present invention relates to exercise and stretching equipment and, in particular, to a multiple station exercise and stretching apparatus which allows the user, regardless of the exercise or stretching motion being performed, to always stretch in a preferred ergonomic and physiologically acceptable fashion.

BACKGROUND OF THE INVENTION

When a person is participating in a sport it is desirable to perform warm-up exercises to help stretch the muscles which will be used in that sport. In order to fully stretch those muscles, however, the person must position his or her body in a particular manner in order to correctly stretch the muscles being used. In a sport such as golf, many muscle groups must be stretched and warmed-up in order to perform the golf swing in a reasonable manner. Until the present invention, the participant in a sport and in particular a golfer, must rely on their own knowledge of stretching in order to perform any warm-up exercises before attempting a golf swing. Thus, many golfers simply use the golf club to stretch overhead or behind one's back or neck in order to loosen up before taking a golf swing. However, the dynamics and mechanics of a golf swing are particularly complex and involve the entire body.

Until the present invention, there has not been a multiple station exercise and stretching apparatus which allows a golfer to perform the necessary stretching and warm-up steps in order to sufficiently carry out and perform a reasonable golf swing or to engage in other exercises or sports. In order to perform a reasonable stretching of the necessary muscles, a person needs to stretch muscles using the greatest resistance. However, a person usually stretches the muscles using the weakest resistance such that the necessary muscle groups have not been adequately stretched.

Further, various muscle groups need to be simultaneously stretched to prepare the participant's body for a reasonable golf swing. This is especially important since a golf swing involves most muscles in the body not just the muscles of the back and hips.

SUMMARY OF THE INVENTION

The present invention provides an improved multiple station exercising and stretching apparatus. Each station comprises a piece of stretching or exercise equipment such that various types of stretching exercises can be performed at each station.

In a preferred embodiment, the stations are adjacent each other so that the user stretches at the first station, then moves to the second station, and so on. A primary feature of the present invention is that the multiple station stretching apparatus allows a person to safely stretch muscles in a progressive manner. Each muscle group is warmed-up and stretched and, in turn, those stretched muscle groups are used to aid in stretching the subsequent muscle group. Each stretching exercise builds on the previous exercise so that all the muscles are stretched in a cumulative manner.

A multiple station exercise and stretching apparatus described herein has six stations. However, it should be understood that other embodiments (for example, an apparatus to be used with a sport other than golf) can have different stations or a different combination of stations. A first exercise station stretches the ankle, foot and calf muscles. The first exercise station has a plurality of spaced apart horizontal bars for the user to grasp while leaning forward and keeping the feet on the ground. A second exercise station stretches the previous muscles and also stretches the hip flexor muscles. The second exercise station includes a foot support having a generally planar middle support portion, a first side angled support portion which is positioned at an angle to a horizontal plane defined by the middle support portion and a second side angled support portion which is positioned at an opposing angle to the horizontal plane defined by the middle support portion. In a preferred embodiment, the second exercise station also has at least one horizontally extending grasping bar which is in a spaced apart relationship to the foot support. A third exercise station stretches the previous muscles and also stretches the hamstring muscles. The third exercise station includes at least one foot stirrup operatively mounted at an angle for supporting a foot. The third exercise station includes at least one horizontally extending bar which is in a spaced apart relationship to the foot stirrup. A fourth exercise station stretches the previous muscles and also stretches muscles from the pelvis to the neck. The fourth exercise station includes an upper gripping member having bars which angle in a rearward and downward direction. The fourth exercise station further includes at least one lower gripping device which is positioned at an angle to the upper gripping device. A fifth exercise station stretches the previous muscles and also stretches the chest muscles. The fifth exercise station includes a plurality of vertically extending bars. A sixth exercise station stretches the previous muscles and also stretches the back and shoulder muscles. The sixth exercise station includes an overhead stretching device having a plurality of angled bars mounted on a center support. The center support has a first end which is positioned at a first distance from a vertical support and a second end spaced at a second and shorter distance from the first end such that the angled bars are held at a preferred angle. Each exercise station preferably includes a support platform to keep the user's feet at a preferred angle. The support platform includes a first angled mat which angles upwardly from a midline and a second angled mat which angles upwardly in an opposite direction from the first angled mat. The support platforms adjacent each exercise station are spaced apart from and are generally perpendicular to the exercise stations such that a user stands on each support platform to use each exercise station.

The multiple station exercise apparatus of the present invention can be used for many types of exercises. However, for ease of illustration, the multiple station exercise and stretching apparatus will be described specifically in connection with performing a golf swing. However, it should be understood that various other sports also involve the use of multiple muscle groups and that a person can use the apparatus of the present invention to perform such stretching exercises. In particular, other contemplated sports include: racket sports such as tennis, racquetball and squash; baseball, softball, cricket, lacrosse, and the like.

The present invention thus provides an exercise apparatus that allows the user to safely exercise and stretch each group of muscles in a logical and cumulative fashion. The multiple station exercise apparatus of the present invention also allows the user to perform many stretching exercises to sufficiently stretch and warm-up every part of the body needed to perform a golf swing. The multiple station exercise apparatus of the present invention allows the user to perform all of the various stretching exercises in one centralized location. The multiple station exercise apparatus is compact and requires comparatively few pieces of equipment. The multiple station exercise apparatus allows the user to perform multiple stretching exercises without spending time resetting the apparatus in order to perform certain exercises. The user can perform the stretching exercises without the need to handle weights or to make adjustments for his or her own particular height and/or flexibility.

Other objects and advantages of the present invention will become apparent to those skilled in the art upon a review of the following detailed description of the preferred embodiments and the accompanying drawings.

DETAILED DESCRIPTION OF THE PREFERRED EMBODIMENT(S)

Figure 1:
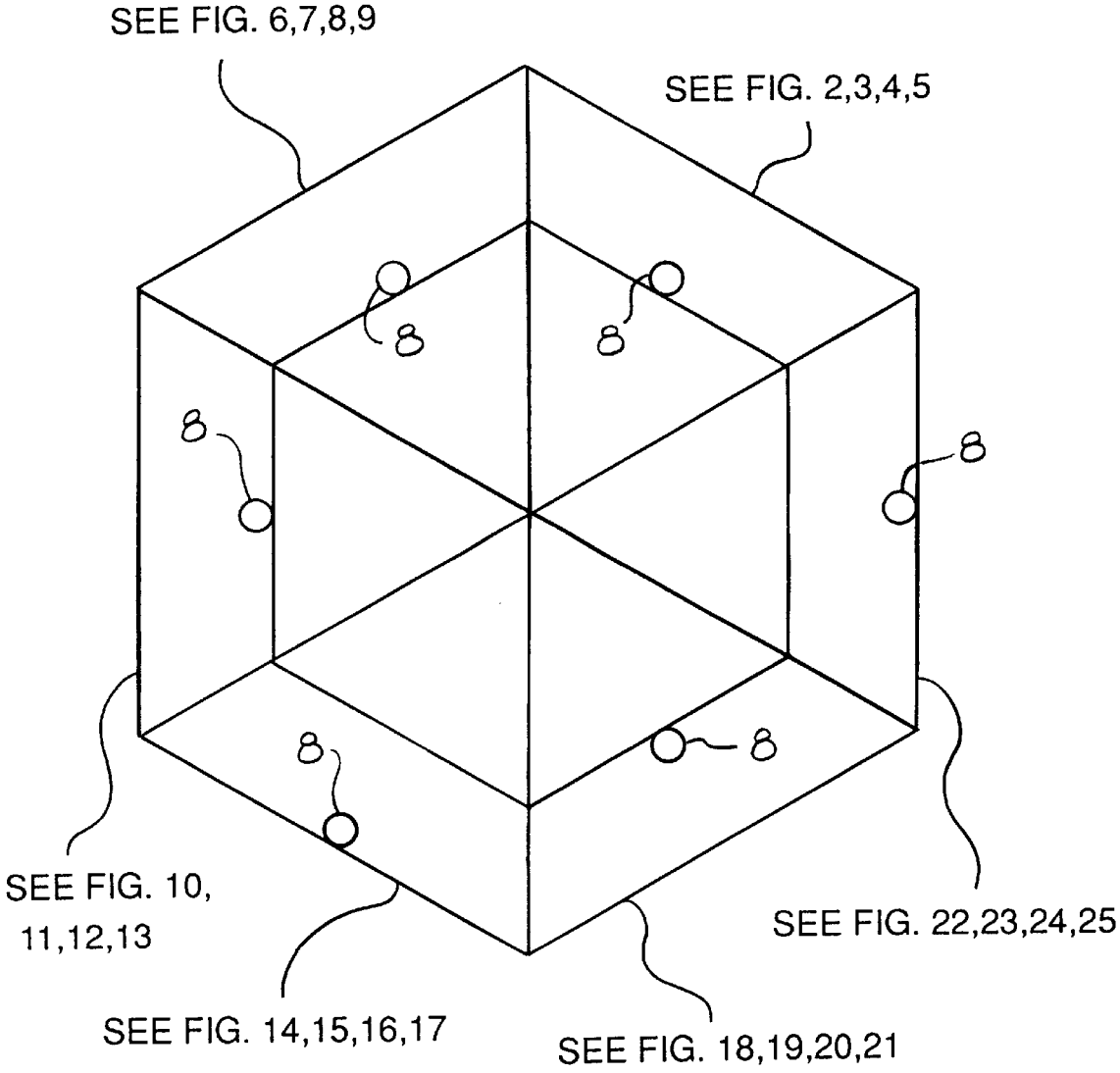
FIG. 1 is a schematic plan view of a multiple station exercise apparatus showing how the various stations of the exercise apparatus are positioned in the exercise apparatus.

FIG. 1 is a schematic diagram illustrating various positions for individual exercise stations in a multiple station exercise apparatus of the present invention. It is desired that the exercises be completed by the user in sequence. In preferred embodiments, the multiple station exercise apparatus can be assembled so that the user moves in a clockwise or counter-clockwise direction as the user completes the exercises or stretches. Each exercise station will be described in detail in a preferred sequence for completing each exercise. However, it should be understood that the exercises can be completed in any order by the user. Further, each exercise will be described in connection with the mechanics and physiology involved in performing a golf swing. The schematic diagram of FIG. 1 shows a preferred embodiment of the present invention where a golf ball 8 is to be positioned when the user is performing the particular stretches and exercises at each station. In a preferred embodiment, the golf ball 8, or a marking where a golfer should be focused, can be positioned on or embedded in a support platform, as will be further explained in connection with the subsequent figures.

Figures 2, 3, 4:
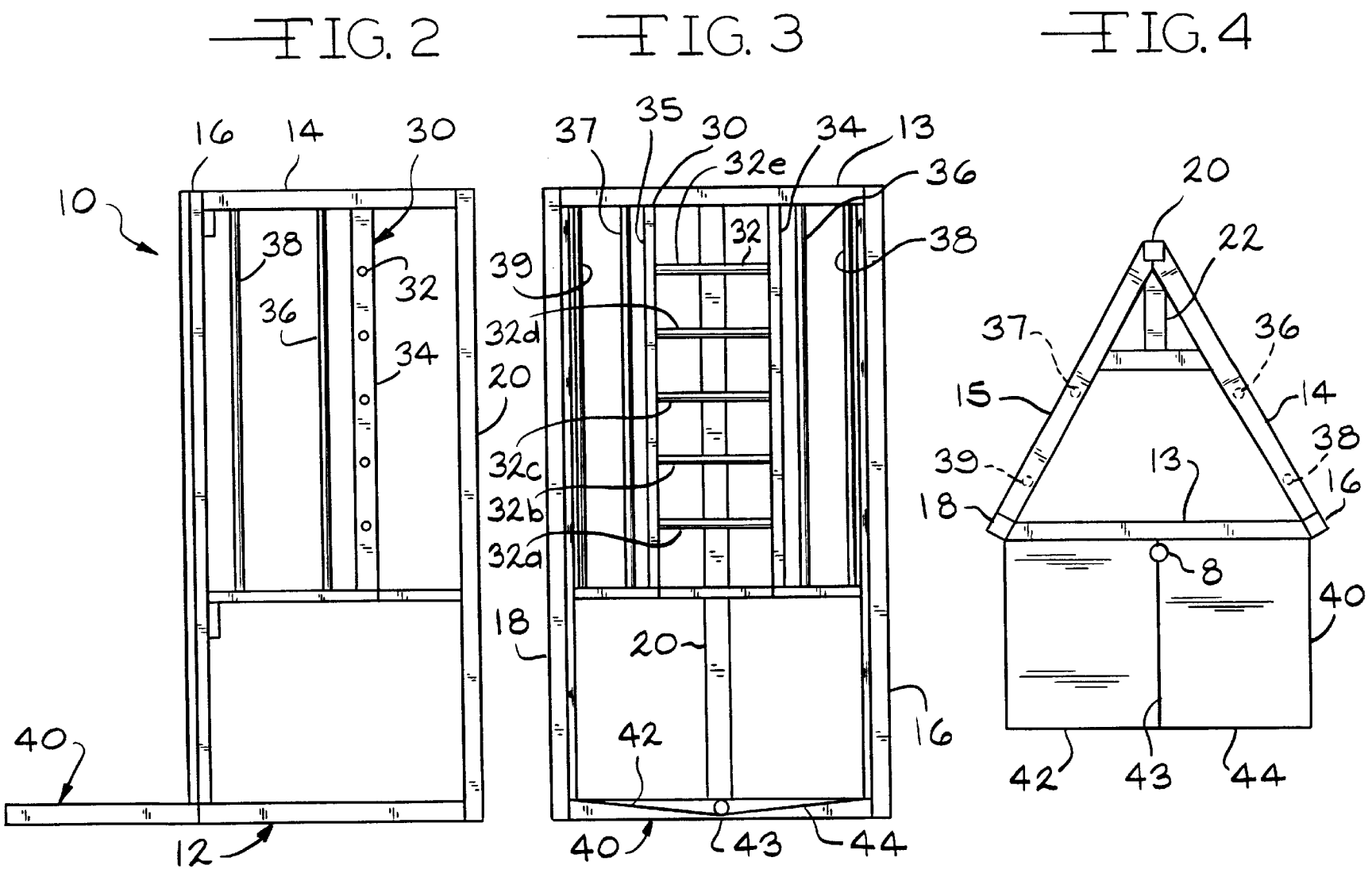
FIG. 2 is a side elevation view of one embodiment of a first exercise station.
FIG. 3 is a front elevation view of the first exercise station shown in FIG. 2.
FIG. 4 is a plan view, partially in phantom, of the first exercise station shown in FIGS. 2 and 3.
Figure 5:
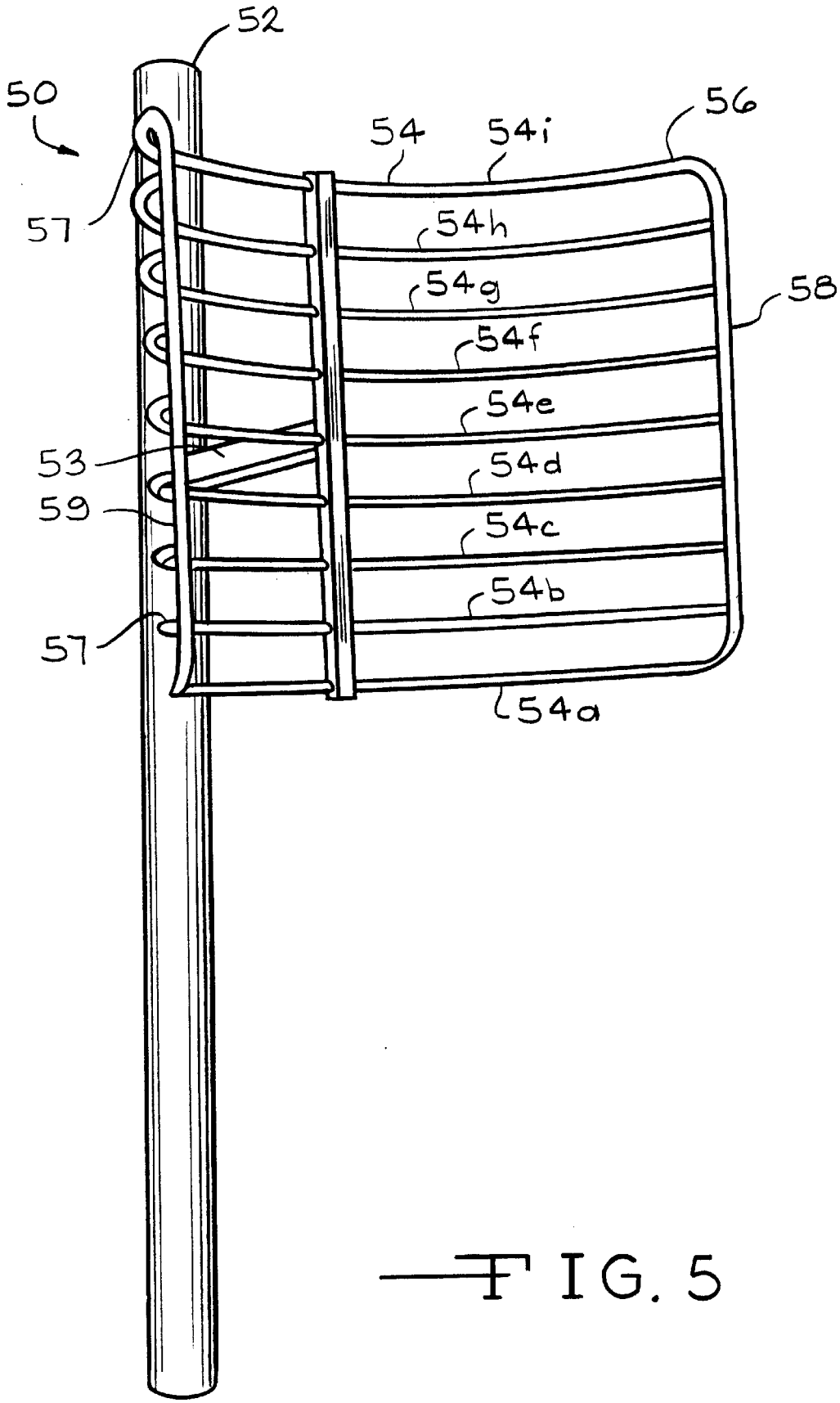
FIG. 5 is a perspective view of an alternative embodiment of a first exercise station.

One embodiment of a first exercise station 10 is shown in FIGS. 2, 3 and 4. The first station 10 is shown as being constructed within individual supporting frame members and can be made of wood and/or metal materials. In contrast, another embodiment of the first exercise station, shown in FIG. 5, is made of a suitable tubular material and is free-standing or can be mounted within a gazebo-type structure.

Referring again to FIGS. 2, 3 and 4, the first exercise station 10 comprising a first stretching device 30 will be generally described. A frame 12 has opposed horizontally extending side support members 13, 14 and 15 which are operatively connected to vertical support members 16, 18 and 20 to form a generally triangular shape, as shown in FIG. 4. However, it should be understood that the frame 12 can have other shapes and that such shapes are within the contemplated scope of the present invention. Mounted within an apex formed by side support members 14 and 15 and vertical support member 20 is an interior support member 22 which is operatively connected to the first stretching device 30.

The first stretching device 30 comprises a plurality of spaced apart horizontal bars 32 connected to a pair of opposed vertical support members 34 and 35. In addition, the first stretching device 30 includes first pair of vertically extending gripping bars 36 and 37 which are in a spaced apart relationship to the vertical support members 34 and 35. In a preferred embodiment, the first stretching device 30 also includes a second pair of vertically extending gripping bars 38 and 39 which are in a spaced apart relationship to the first pair of vertical gripping bars 36 and 37, respectively.

It is also within the contemplated scope that preferred embodiments of the first stretching device 30 include a support platform 40 which can be placed at a comfortable angle, as best shown in FIG. 3, to position and support the user. The support platform 40 includes a first angled mat 42 and a second angled mat 44 which are positioned at an angle from about 4° to about 8° with respect to the floor or support surface upon which the stretching device 30 is positioned, and most preferably at about a 6° angle, from a midline 43. The first and second angled mats 42 and 44 slope upwardly from the midline 43 of the support platform 40. In practice it has been found that positioning the first and second angled mats 42 and 44 at an angle of about 6° is preferable. When the user stands on the platform, the user's feet are positioned at an angle as the user's body is turned or rotated and stretched. The angled position of the feet allows the body to stretch more effectively. As each foot stays at the desired angle, rotation of the user's body allows the muscles in the legs and torso to more fully stretch.

The first stretching device 30 is designed to stretch the ankle, foot and calf muscles by longitudinally extending these muscles. The user faces the first stretching device 30 and takes a step forward on one of the angled mats to position one foot closer to the horizontal bars 32. The other foot remains positioned on the other angled mat. The user leans forward and grasps a first horizontal bar 32*a* keeping his heels down on the angled mats 42 and 44. The angled floor mats 42 and 44 keep the feet positioned at the desired angle so that the desired foot position is maintained during the stretch. As the muscles are stretched, the user can reach for higher horizontal bars 32*b*–32*e* to further elongate or stretch the muscles. This stretching is done in rotation for both feet and legs on the right and left sides. Afterwards, the user places his feet in a stationary or golf position keeping his heels on the ground and his knees over his feet for balance. The user reaches to one side to grasp the vertical bars 37 and/or 39 such that muscles are stretched when the body is in a turned position. While the user is leaning forward, both calves are continuing to be stretched. As the body is rotated to one side and then the opposite side, the muscles of the legs, hip and torso are elongated and stretched. It is especially important to stretch the lower calf muscles to create a strong base for a golf swing.

FIG. 5 shows an alternative embodiment of a first stretching device 50. The first stretching device 50 is operatively mounted on a vertical support member 52 by a horizontally extending support member 53 which extends from the vertical support member 52. The first stretching device 50 includes a plurality of curved horizontally extending grasping bars 54. Each grasping bar 54 has opposed curved distal portions 56 and 57 which radially curve in a direction away from the support member 53. In a preferred embodiment, the grasping bars 54 can be made of a tubular material and terminate at opposed vertically extending support members 58 and 59.

While not shown in connection with the embodiments shown in FIGS. 5, 9, 13, 17, 21 and 25, it is to be understood that the optimum stretching occurs when the user is standing on a platform such as the support platform 40. For ease of explanation the platforms will not be shown in these embodiments; however, it is to be understood that the user will preferably perform the exercises for these embodiments while standing on a support platform such as the support platform 40 shown in FIGS. 2–4.

In order to use the first exercise station 50, the user faces the first stretching device 50 and takes a step forward with one foot forward and the other foot behind as previously described. The user stretches and grabs a first horizontal bar 54*a* keeping his heels down on the support platform (not shown in FIG. 5). As the muscles are stretched, the user reaches for higher horizontal bars 54*b*–54*i* to further elongate or stretch the muscles. The stretching is done for the feet and legs on the right and left sides. Afterward, the user remains in the stationary golf position and reaches to one side to grasp the curved portions 56 and/or 57 of the horizontal bars 54 such that the muscles are stretched when the body is in a turned position.

Figure 8:
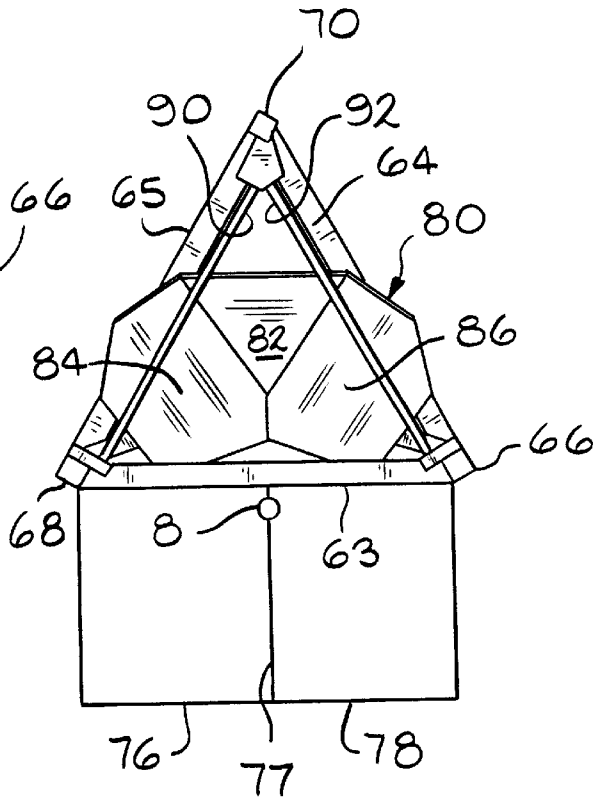
FIG. 8 is a plan view of the second exercise station shown in FIGS. 7 and 8.
Figure 7:
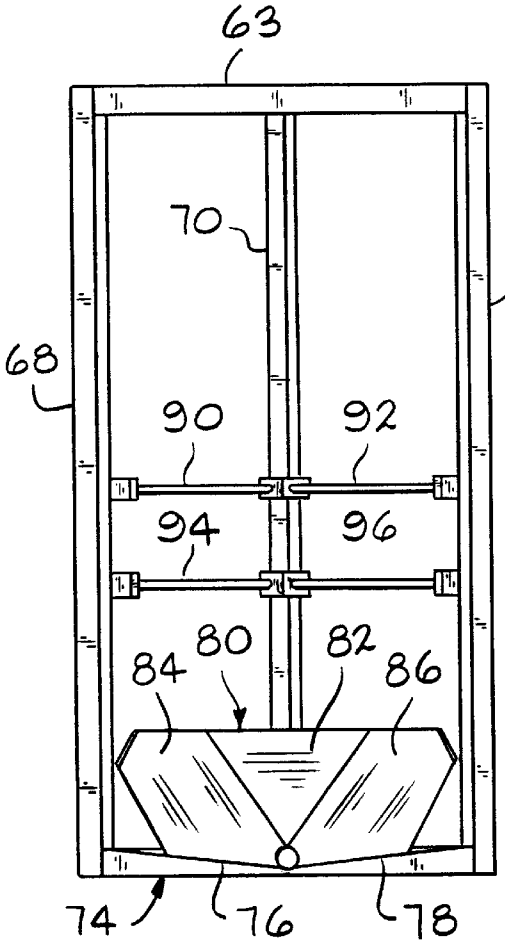
FIG. 7 is a front elevation view of the second exercise station shown in FIG. 6.
Figure 6:
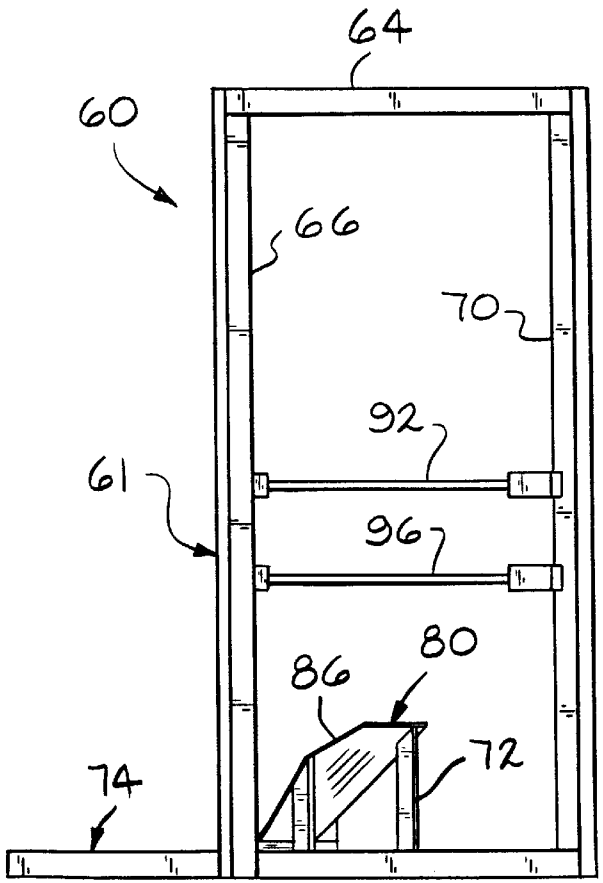
FIG. 6 is a side elevation view of one embodiment of a second exercise station.

FIGS. 6, 7 and 8 show a second exercise station 60 comprising a second exercise device 61 which provides hip extension and stretching. A frame 62 has opposed horizontally extending side support members 63, 64 and 65, which provide similar support as the side support members 13, 14 and 15 in FIGS. 2–4. The side support members 63, 64, and 65 are operatively connected to vertically extending support members 66, 68 and 70 to form a generally triangular shape structure, as shown in FIG. 8, to support the second exercise device 61.

The second exercise device 61 includes a foot support 80 which is operatively connected to the frame 62 by a foot support frame member 72. In a preferred embodiment of the present invention the foot support 80 is positioned at about a 45° angle. However, it is also within the contemplated scope of the present invention that the foot support 80 can be positioned at other angles and that the foot support frame member 72 can have adjustable brackets (not shown) which can position the foot support 80 at selected other angles. The foot support 80 includes a middle or planar support portion 82 and first and second side angled support portions 84 and 86, respectively. The side angled support portions 84 and 86 are positioned at an angle to a horizontal plane defined by the middle support portion 82. The side angled portions 84 and 86 extend from the planar middle portion 82 in a direction toward the user. Each side angled portion 84 and 86 is at a preferred angle to the planar portion 82 so that, as the user places his foot on the angled portion 84 or 86, the foot remains steady and does not slip or turn.

Optimum stretching occurs when the user is standing on a support platform 74 which is substantially the same as the previously described support platform 40. The support platform 74 includes a first angled mat 76 and a second angled mat 78 which slope upwardly at an angle from about 4° to about 8° angle from a midline 77.

The user places a foot on the middle portion 82 and leans toward the support member 70 to initiate the stretch. This movement causes the calf muscle and the hip flexor muscles to stretch. The hip flexor muscles are important to stretch since they connect the torso to the leg and generally are the major muscles used in forward propulsion in walking. The second exercise device 61 further includes at least a first pair of horizontally extending grasping bars 90 and 92 and preferably a second pair of grasping bars 94 and 96. The grasping bars 92 and 96 extend in one direction between the vertical support members 66 and 70 while the opposing grasping bars 90 and 94 extend in the opposite direction between the vertical support members 68 and 70. As the user places his foot on the foot support 80 and leans or stretches forward, the grasping bars 90 and 92 are gripped by the hands of the user to provide support and balance during the stretching motion. The support bars 90 and 92 are horizontally aligned so that the user can reach forward and stretch. The user then places his right foot on the left angled foot support portion 84 while turning his body and reaching or grasping the right grasping bars 92 or 96. The user then repeats the stretching in the opposite direction, placing the left foot on the right angled support portion 86 while turning his body and reaching or grasping the left grasping bars 90 and 94. The lower grasping bars 94 and 96 can be used to accommodate smaller individuals or to vary the intensity of the stretching motion.

Figure 9:
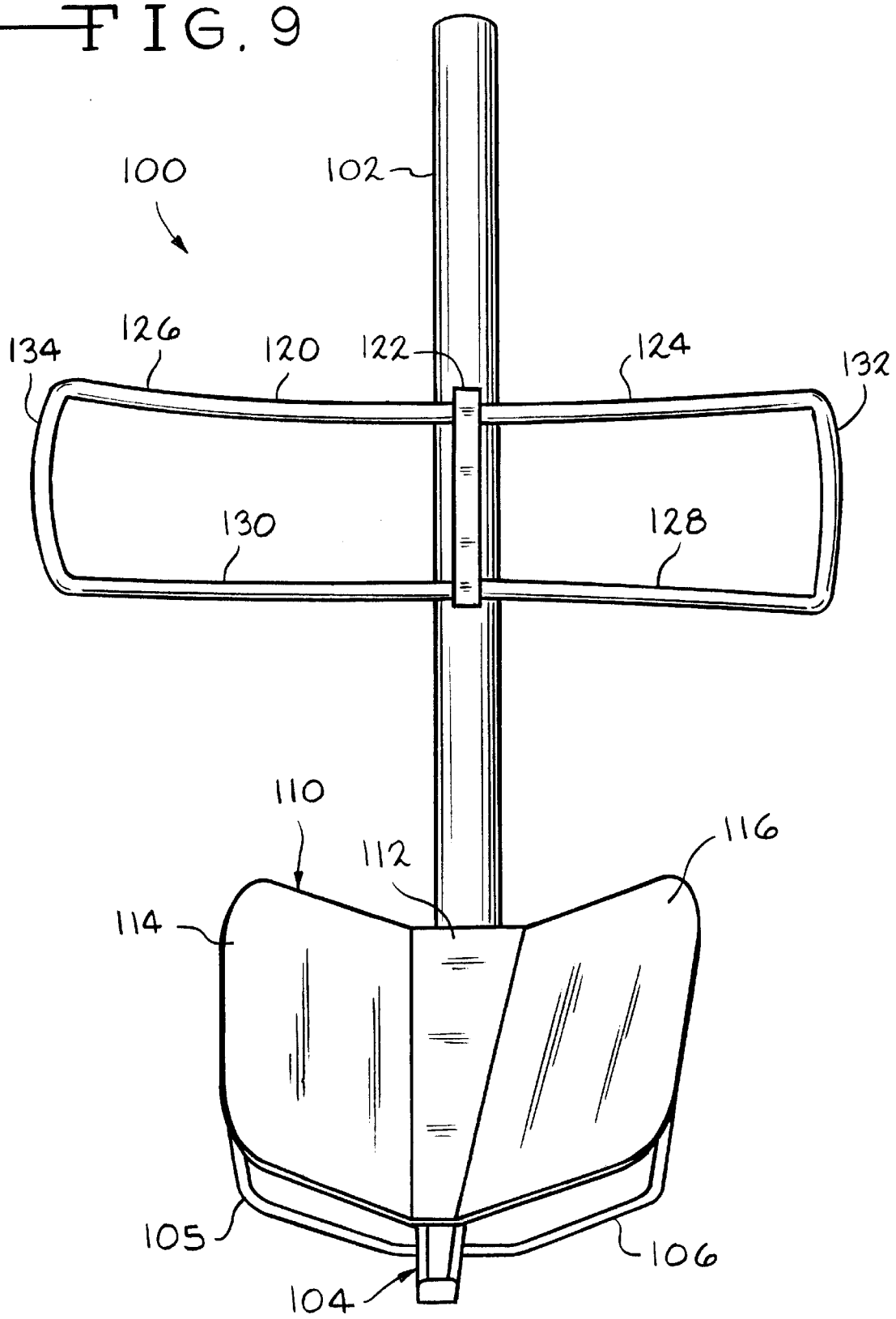
FIG. 9 is a perspective view of an alternative embodiment of a second exercise station.

FIG. 9 shows an alternative embodiment of a second exercise station 100. The second exercise station 100 is operatively mounted on a vertical support member 102. A foot support 110 is operatively connected to the vertical support member 102 by a slanted support member 104. The slanted support member 104 has support bars 105 and 106 which help keep the foot support 110 at a preferred angle, as described for FIGS. 6–8. It is also within the contemplated scope of the present invention that the foot support 110 can be adjustable to be able to be positioned at various desired angles. The foot support member 110 includes a middle or planar support portion 112 and a first and second side angled support portions 114 and 116, respectively, that are substantially the same as the previously described foot support 80. The side angled support portions 114 and 116 are positioned at an angle to a horizontal plane defined by the middle support portion 112. The side angled portions 114 and 116 extend from the middle portion 102 in a direction toward the user. Each side angled portion 114 and 116 is at a preferred angle to the middle portion 112 so that as the user places his foot on the angled portions 114 or 116, the foot remains steady and does not slip or turn.

The second exercise station 100 also includes a handle support 120 which is operatively connected to the vertical support member 102 by a horizontally extending bar 122. The support handle 120 includes first and second upper horizontally extending bars 124 and 126, respectively, and first and second lower horizontally extending bars 128 and 130, respectively. The first bars 124 and 128 and the second bars 126 and 130 can be operatively joined with vertically extending portions 132 and 134, respectively. In certain embodiments, each side of the handle support 120 can be formed in an integral manner such that one side of the handle support 120 comprises the upper bar 124, the side vertically extending portion 134 and the lower bar 128. The other side of the handle support 120 can comprise the upper bar 126, the side vertically extending portion 134, and the lower bar 130. In the embodiment shown in FIG. 9, the upper bars 124 and 126 and the lower bars 128 and 130 curve in a radial manner in a direction away from the support member 102 and in a direction toward the position where the user will stand. The curved radii of the horizontal bars 124, 126, 128 and 130 allow the user to readily grasp the bars as the user has his foot secured on either of the side angled portions 114 or 116.

As the user places his foot on the middle foot support portion 112 and stretches forward, the user holds the grasping bars 124, 126, 128 and/or 130. The user then places his right foot on the left angled support portion 114 while turning his body and reaching or grasping the first upper and lower bars 24 and/or 28. The user then repeats the stretching in the opposite direction, placing the left foot on the angled support portion 116 while turning his body and reaching or grasping the second bars 126 and 130.

Figures 10, 11, 12:
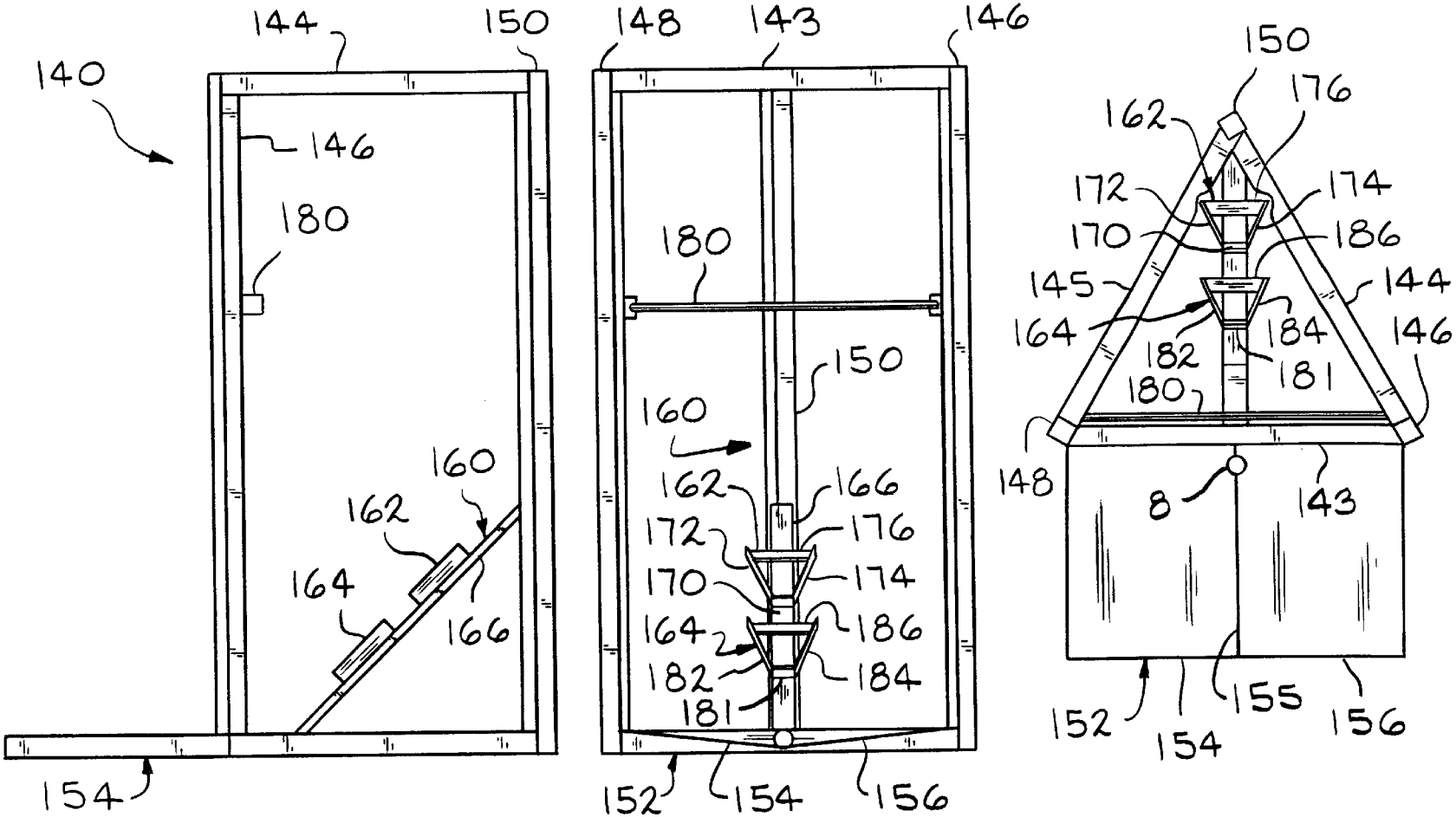
FIG. 10 is a side elevation view of one embodiment of a third exercise station.
FIG. 11 is a front elevation view of the third exercise station shown in FIG. 10.
FIG. 12 is a plan view of the third exercise station shown in FIGS. 11 and 12.

FIGS. 10, 11 and 12 show a third exercise station 140 which provides calf muscle, hip flexor and ham string extension and stretching. The third exercise station, in particular, stretches the hamstrings which provide the power source to a rotational movement of the body. The hamstring muscles include three sets of muscles, two of which are attached to the inner portion of the leg, and one of which attaches to the outer portion of the leg. The third exercise station stretches all portions of the hamstring.

A frame 142 has opposed horizontally extending side support members 143, 144 and 145, which provide similar support as the side support members in the earlier described Figures. The side support members 143, 144 and 145 are operatively connected to vertically extending support members 146, 148 and 150 to form a generally triangular shape, as shown in FIG. 12, to support the third exercise station 140.

Optimum stretching occurs when the user is standing on a support platform 152 as previously described. The support platform 152 includes a first angled mat 154 and a second angled mat 156 which slope upwardly at an angle from about 4° to about 8°, preferably about 6° angle from a midline 155.

The third exercise station 140 includes a heel support 160 which includes at least one, and preferably a pair of, foot stirrups or brackets 162 and 164 which are operatively mounted on a slanted support bracket 166. In a preferred embodiment the bracket 166 is positioned at about a 45° angle; however, it is also within the contemplated scope of the present invention that the bracket 166 can be positioned at other angles or be adjustable to be able to be positioned at various angles.

The stirrup 162 includes a heel support portion 170 and a first angled support section 172 which extends at an upwardly acute angle from the heel support 170 and a second angled support section 174 which extends upwardly at an acute angle in an opposing direction from the heel support 170. The angled support sections 172 and 174 form a generally triangular shape. A third support portion 176 operatively connects the angled support sections 172 and 174. In a preferred embodiment, the third exercise station 140 further includes the second foot stirrup 164 which is substantially the same as the previously described foot stirrup 162. The second foot stirrup 164 is positioned on the slanted support bracket 166 in a spaced apart relationship with the foot stirrup 162. The second foot stirrup has a heel support 180, a first angled support 182, and an opposing angle support 184. The first angled support 182 extends at an upwardly acute angle from the heel support 180. The second angled support section 184 extends upwardly at an acute angle in an opposing direction from the heel support 180. The angled support sections 182 and 184 form a generally triangular shape. A third support portion 186 operatively connects the angled support sections 182 and 184. The third exercise station 140 further includes at least one support grasping bar 180 which is positioned horizontally between the vertical support members 146 and 148.

In order for the user to now simultaneously stretch the calf muscles, the hip flexors and the hamstrings, the user stands on the angled mat portions 152 and 156 which aid in keeping the calf stretched and in a proper everted position. The user places one foot on the heel rest 170 while grasping the support bar 180 and leaning forward. This motion stretches the calf muscle, the hip flexor muscles and the hamstrings. In order to achieve full stretching of the hamstring, the user rotates the foot toward the first angled support 172 and stretches and then rotates the foot to the opposing angled support 174 and stretches. If the right foot is positioned on the heel support portion 170, the toe portion of the foot is rotated in a direction toward the first angled support portion 172 which stretches the outer hamstring muscles. The user is instructed to then rotate his foot to opposing second angled support portion 174 which stretches the inside hamstring muscles. In certain stretching regimes, the user first performs this stretching while having his chest facing the foot stirrups 160 and 162. The user then performs a stretch in the side direction and stretches while having his shoulder facing the foot stirrups 160 and 162.

Figure 13:
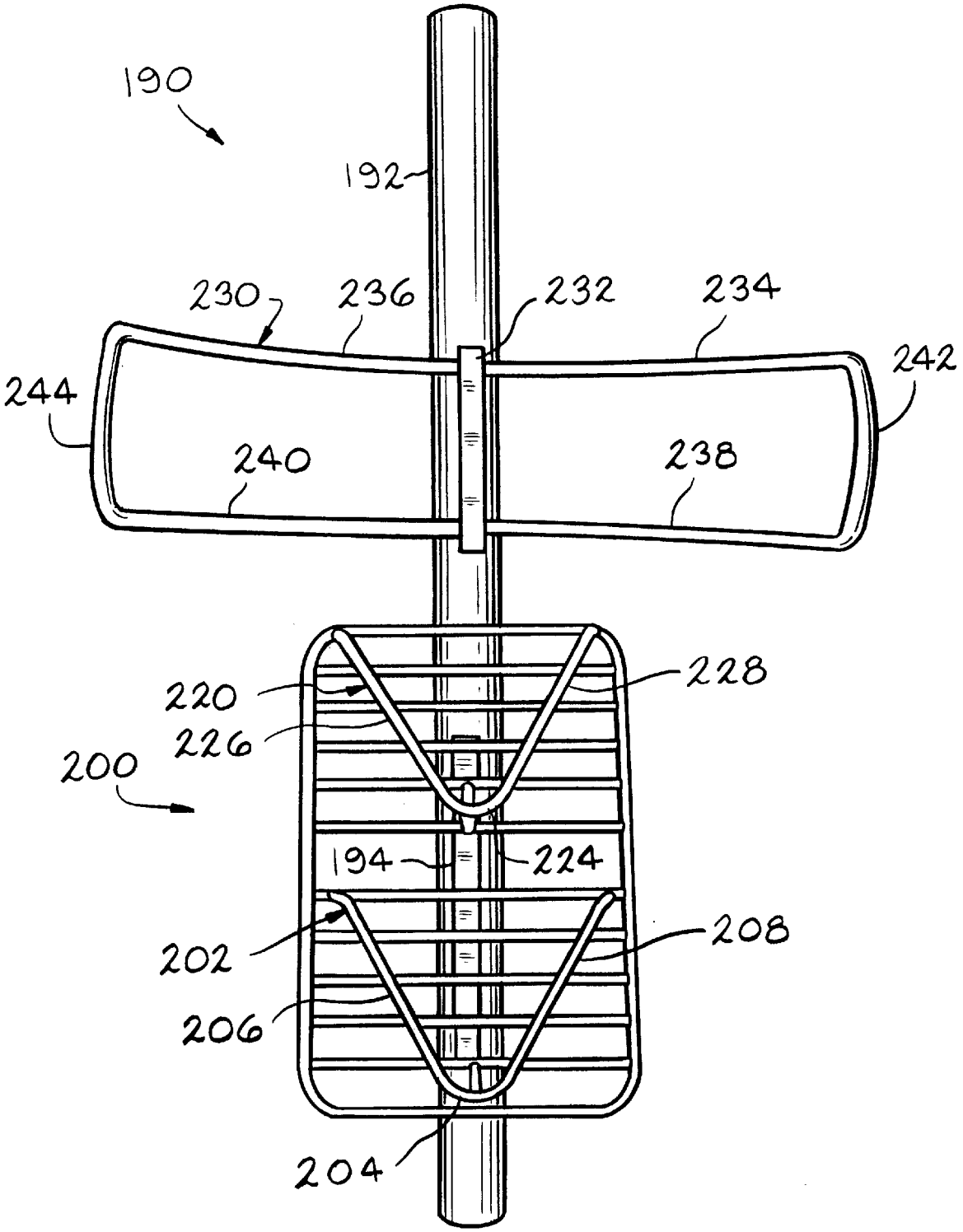
FIG. 13 is a perspective view of an alternative embodiment of a third exercise station.

FIG. 13 shows an alternative embodiment of a third exercise station 190. The third exercise station 190 is operatively mounted a vertical support member 192. At least one heel support 200 is operatively connected to the vertical support member 192 by a slanted support member 194, which can be adjustable in certain embodiments to vary the position of the feet support 200.

The heel support 200 includes a first or lower foot bracket or stirrup 202. The stirrup 202 has a heel support portion 204 and a first angled support portion 206 which extends at an upwardly acute angle from the heel portion 204 and an opposing second angled support portion 208 which extends upwardly at an acute angle in an opposing direction away from the heel support 204.

In a preferred embodiment, the third exercise station 190 further includes a second foot stirrup 220, that is substantially the same as the heel support 200, mounted on the slanted support member 190. The second foot stirrup 220 has a heel support portion 224 and a first angled support portion 226 which extends at an upwardly acute angle from the heel portion 224 and an opposing second angled support portion 228 which extends upwardly at an acute angle in an opposing direction away from the heel support 224.

The heel support 200 is positioned at an angle toward the vertical support member 192 such that the foot is held in a stretched position. The third exercise station 190 also includes a handle support 230 which is operatively connected to the vertical support member 192 by a horizontally extending bar 232. The support handle 230 includes first and second upper horizontally extending bars 234 and 236, respectively, and first and second lower horizontally extending bars 238 and 240, respectively. The first bars 234 and 238 and the second bars 236 and 240 can be operatively joined with vertically extending portions 242 and 244, respectively. In certain embodiments, each side of the handle support 230 can be formed in an integral manner such that one side of the handle support 230 comprises the upper portion 234, the side vertically extending portion 242 and the lower bar 248. The other side of the handle support 230 can comprise the upper bar 236, the side vertically extending portion 244 and the lower bar 240. In the embodiment shown in FIG. 13, the upper bars 234 and 236 and the lower bars 238 and 240 curve in a radial manner in a direction away from the vertical support member 192 and in a direction toward the position where the user will stand. The curved radii of the horizontal bars 234, 236, 238 and 240 allow the user to readily grasp the horizontal bars as the user has his foot secured in either the stirrup 202 or 220.

The user places his foot at the heel support portion 204 or 224 and reaches forward to grasp the bars 234, 236, 238 and/or 240. The user then rotates the foot about the heel to first to the angled support portions 206 or 226 and then to the second angled support portions 208 or 228, allowing the hamstring muscles on both inside and outside of the legs to be stretched. This exercise is then repeated for the opposite leg.

The first three exercise stations generally provide stretching to the lower body and can be used for many different types of sports. It is also to be understood that other exercises can be performed at each station. For example, at the third exercise station, the user can place his body at a right angle to the stirrups. The user has his shoulder facing the stirrups, places his foot in the heel support, and then rotates the foot to the angled support to stretch groin muscles.

Figures 14, 15, 16:
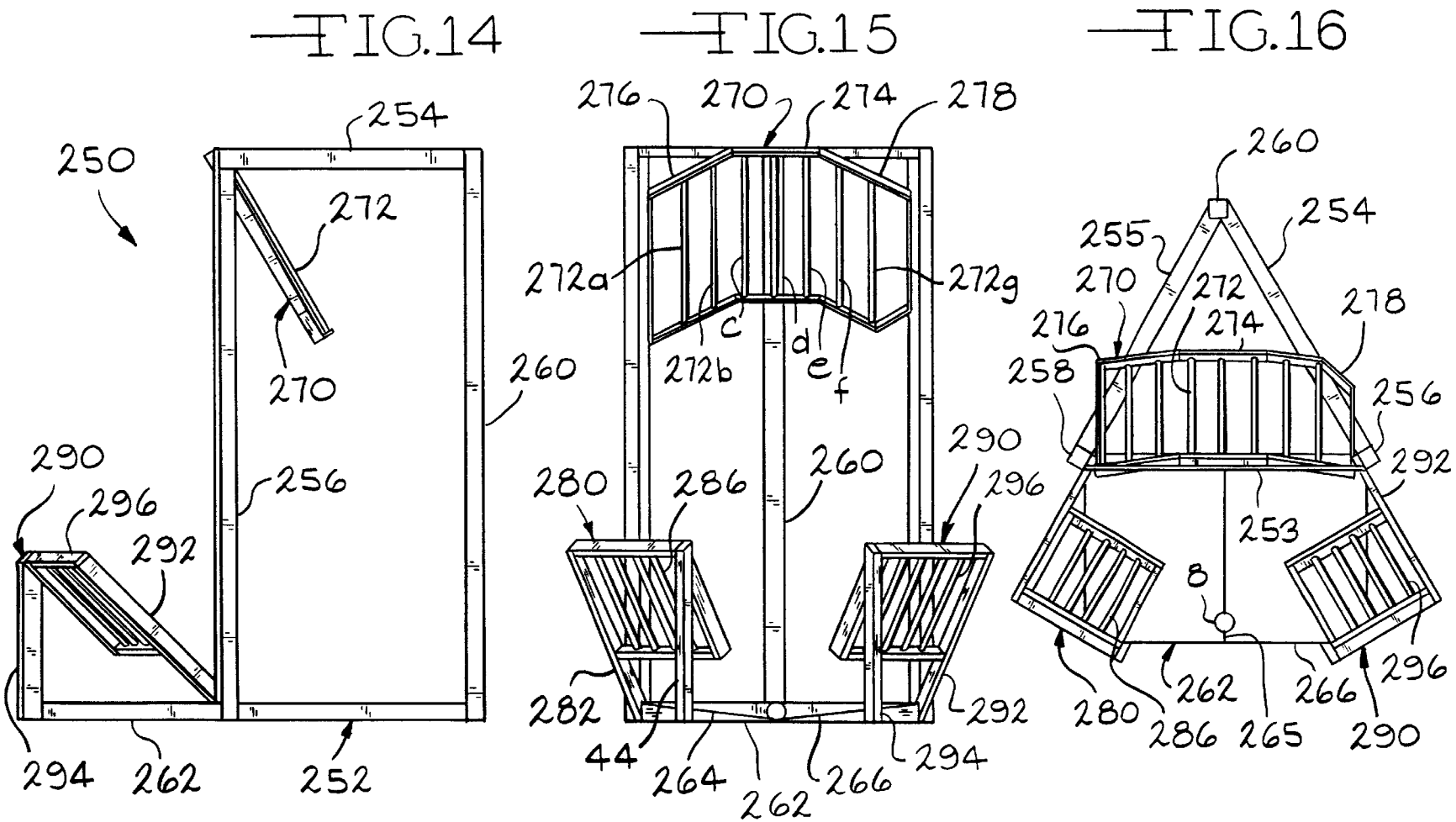
FIG. 14 is a side elevation view of one embodiment of a fourth exercise station.
FIG. 15 is side elevation view of the fourth exercise station shown in FIG. 14.
FIG. 16 is a plan view of the fourth exercise station shown in FIGS. 14 and 15.

FIGS. 14, 15 and 16 show a fourth exercise station 250 which provides stretching for a golf swing. The fourth exercise station, in particular, stretches the muscles from the pelvis to the neck. A frame 252 has opposed horizontally side extending support members 253, 254 and 255 which are operatively connected to vertical support members 256, 258 and 260 which provide similar support structure as the frames described in the earlier Figures.

Optimum stretching occurs when the user is standing on a support platform 262 which includes a first angled mat 264 and a second angled mat 266 which slope upwardly at an angle from about 4° to 8°, preferably about a 6° angle, from a midline 265 as previously described.

The fourth exercise station 250 includes an upper grasping device 270 which comprises a plurality of vertically extending bars 272 which extend in a downward direction from the support members 253, 256 and 258. The upper grasping device 270 is positioned at an angle so that the end of the upper grasping device 270 that is spaced apart from the support members 253, 256 and 258 angles toward and is closer to the vertical support member 260. In a preferred embodiment, the upper grasping device 270 includes a middle or planar portion 274 and first and second angled portions 276 and 278, respectively. The first and second angled portions 276 and 278 are positioned at an angle to a plane defined by the middle portion 274. The first and second angled portions 276 and 278 extend at an acute angle from the plane defined by the middle portion 274 in a direction toward the user.

The fourth exercise device 250 further includes a first lower grasping device 280 and a second lower grasping device 290. The first and second lower grasping devices 280 and 290 are positioned in opposed relationship. The first lower grasping device 280 is operatively mounted on the frame 252 by support member 282 and 284 which support the grasping device 280 at an obtuse angle as defined by the plane of the platform 262. The lower grasping device 280 comprises a plurality of generally vertically extending bars 286.

The second lower grasping device 290 is operatively mounted on the frame 252 by support members 292 and 294 which support the second lower grasping device 290 at an obtuse angle to the plane defined by the platform 262. The lower grasping device 290 includes a plurality of generally vertically extending bars 296. The first and second lower grasping devices 280 and 290 are generally positioned in an opposing or mirror like fashion to each other. Each lower grasping device 280 and 290 is angled in a direction such that the bars 286 and 296 generally face the bars 272 of the upper grasping device 270.

The user stands on the platform 262 with his back to the upper grasping device 270 and generally keeping his head down and facing the support platform 262. The user grasps a bar 296 on the second lower grasping device 290 with the left hand while reaching over his head with his right hand and grasping one of the bars 272. As the user works his way back from bar 272*a* through 272*b* and so on, the user stretches the upper body muscles. This exercise is repeated for the opposite side where the user grasps the bars 286 of the first lower grasping device 280 with the right hand while stretching overhead and grasping bars 272*g* through *f, e, d,* and so on with the left hand.

The user can also take the right hand and grasp the bars 286 while again reaching towards bars 272 such that the user's arm is crossed over his body. This exercise can be repeated for the opposing side.

Figure 17:
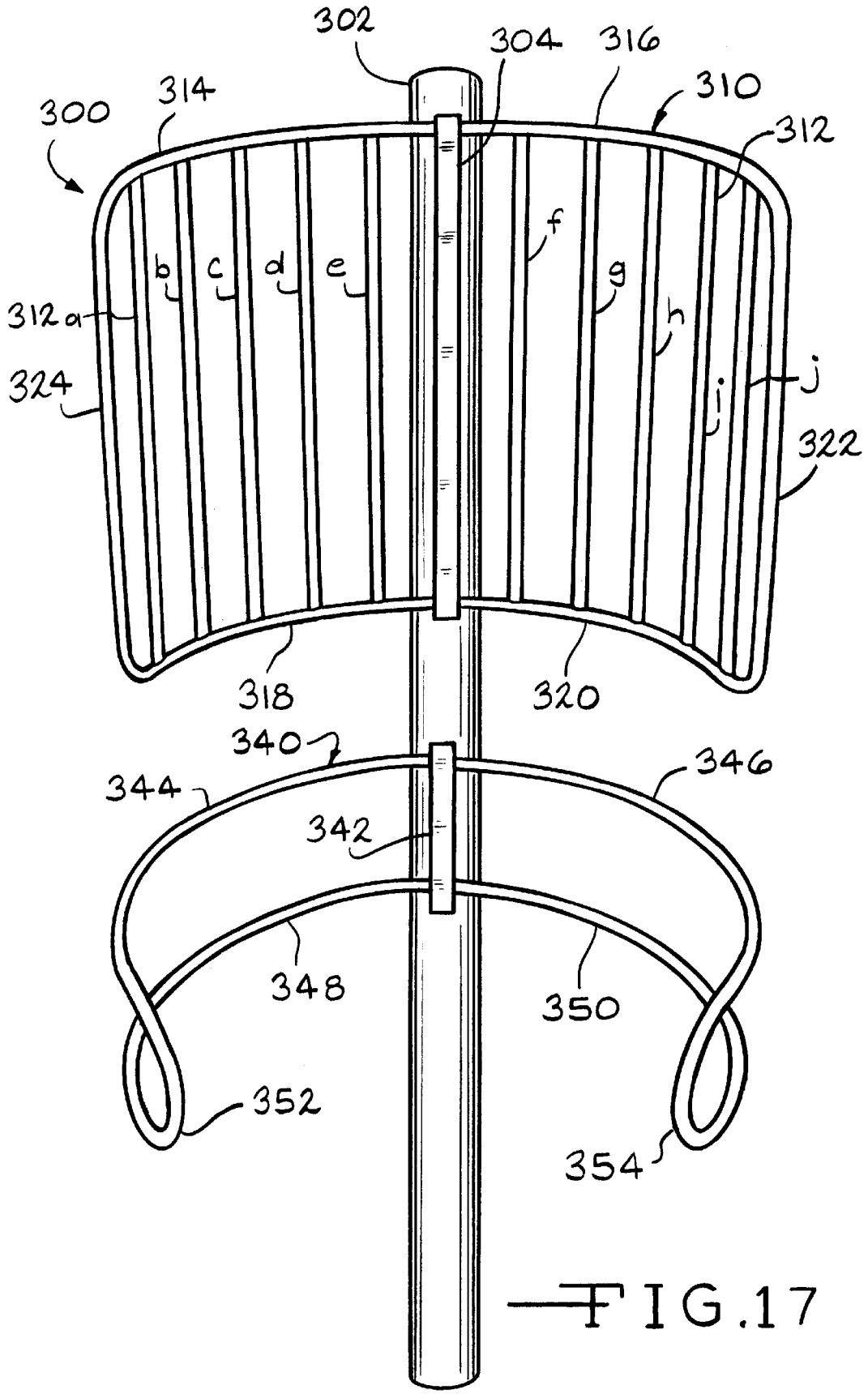
FIG. 17 is a perspective view of an alternative embodiment of a fourth exercise station.

FIG. 17 show an alternative embodiment of a fourth exercise station 300. The fourth exercise station 300 is operatively mounted on a vertically support member 302.

An upper support member 304 extends from the support member 302 in a horizontal direction. An upper stretching device 310 is operatively connected to the support member 304. The upper body stretching device 310 includes a plurality of generally vertically extending bars 312. The vertically extending bars 312 extend from first and second upper curved portions 314 and 316, respectively, and are operatively connected to first and second lower curved portions 318 and 320, respectively. The first curved portions 314 and 318 and the second curved portions 316 and 320 curve in a radial direction away from the support bar 302. The first upper and lower curved portions 314 and 318, respectively, are operatively connected by a first vertical portion 324. The second upper and lower curved portions 316 and 320, respectively, are operatively connected by a second vertical portion 322.

In a preferred embodiment, the first and second upper curved portions 314 and 316 are spaced at a first distance from the vertical support 302. The first and second lower curved portions 318 and 320 are spaced at a second, shorter distance from the vertical support 302. In this embodiment, the upper stretching device 310 is positioned at an acute angle to the vertical support 302.

The fourth exercise station 300 further includes a lower stretching device 340 which extends from the support member 302. The lower stretching device 340 is operatively connected to the vertical support bar 302 by a radially extending bracket 342. The lower stretching device 340 includes first and second upper curved portions 344 and 346, respectively, which extend in a radial direction away from the support bar 302.

The lower stretching device 340 includes first and second lower curved portions 348 and 350, respectively, which extend in a radial direction away from the support bar 302. The first upper curved portion 344 is preferably operatively connected to the first lower portions 348 by a vertically extending or curved portion 352 which joins the portions 344 and 348. The second portions 346 and 348 are operatively connected by a curved portion 354 which generally extends between the second portions 346 and 348. In a preferred embodiment, the portions 342, 346, 352, 354, 348 and 350 are made of a singular tubular piece of material.

In order to stretch the upper body, the user stands with his back to the support member 302. The user assumes a position with his head down. The user places his left hand on either lower portion 246 or 250. The user then takes his right hand and stretches to grasp the vertically extending bar 324. The user then sequentially grasps adjacent bars between 312*a* to 312*b* to 312*c* and so on, to stretch the back muscles. By keeping the left hand steady on the lower support portion 346 or 350 the user is able to open up and stretch his back and neck muscles. As the user stretches, he is able to take advantage of the stretched lower body, calf, hip flexor and hamstrings stretched in earlier stations. The user repeats the same stretches by reversing hands. The user then, while still facing outwardly with his back to the support member 302, sequentially reaches overhead to the upper bars 312*h, g, f* and so on with his left hand while crossing over his body with his right hand, while simultaneously grasping the second portions 346 and/or 350 such that the user's body is rotated in a pivoting manner. This exercise is then repeated using opposing hands. This station provides a dual level stretch by allowing lower rotation of the body at one angle while providing an upper rotation of the body at another angle. This is especially helpful to users who desire to perform a full golf swing. The lower stretching provides pelvis and lower back stretching while the hands extended above the head provide upper back and neck stretching. When the user stretches using these bars and handles as fulcrums, the user is able to achieve optimum stretching rather than just having the body stretch in a path of least resistance.

Figures 18, 19, 20:
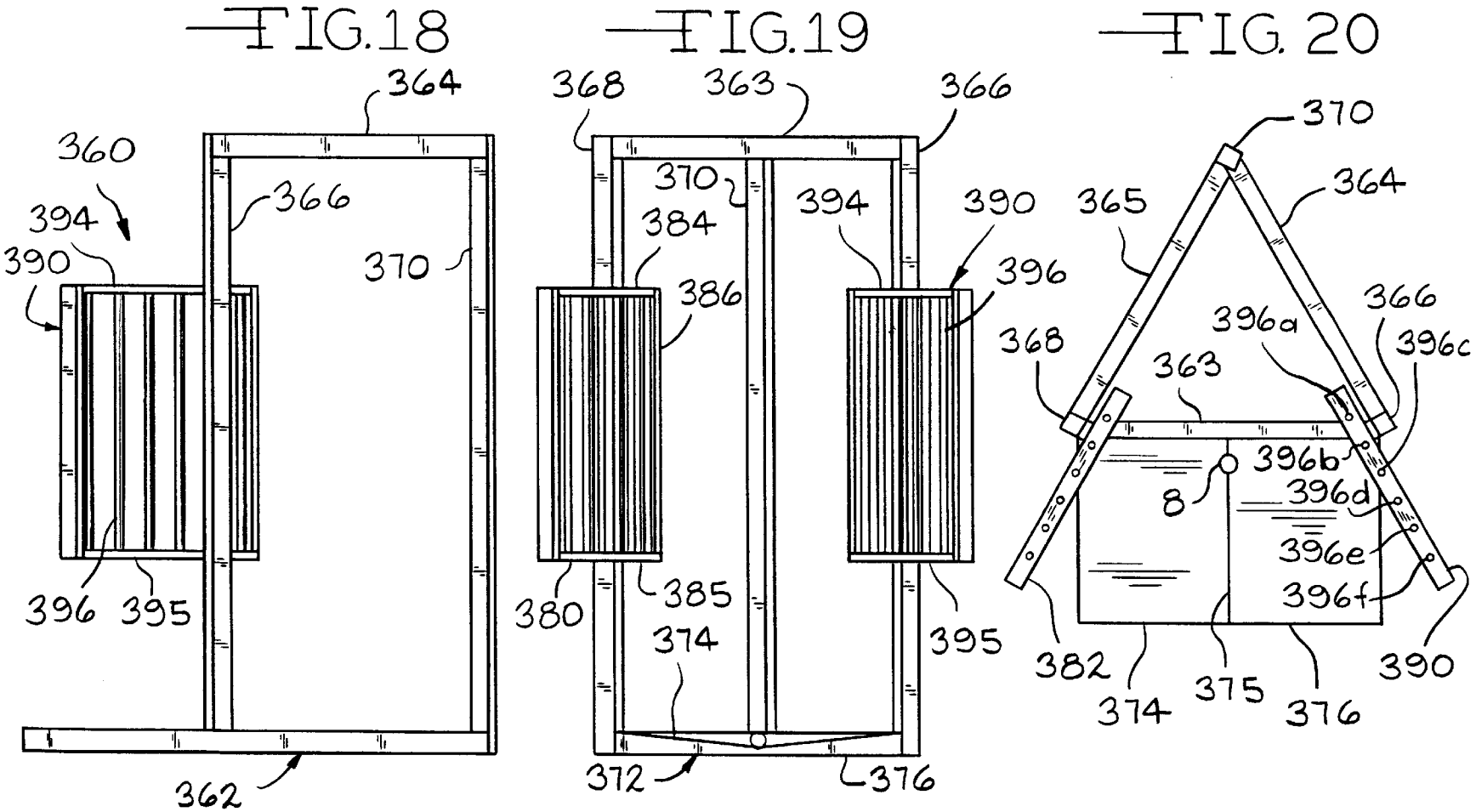
FIG. 18 is a side elevation view of one embodiment of a fifth exercise station.
FIG. 19 is a front elevation view of the fourth exercise station shown in FIG. 18.
FIG. 20 is a plan view of the fourth exercise station shown in FIGS. 18 and 19.

FIGS. 18, 19 and 20 show a fifth exercise station 360 which takes advantage of the first four exercise stations by providing further stretching that is enhanced by the stretching completed in the prior stations. A frame 362 has opposed horizontally extending side support members 363, 364 and 365 which provide similar support as the side support members in the earlier described Figures. The side support members 363, 364 and 365 are operatively connected to vertically extending support members 366, 368 and 370 to support the fifth exercise station 360.

Optimum stretching occurs when the user is standing on a support platform 372 includes a first angled mat 374 and a second angled mat 376 which slope upwardly at an angle from about 4° to about 8°, perferrably at about 6°, from a midline 375.

The fifth exercise station 360 comprises a first shoulder stretching device 380 which is mounted generally at a midportion of the vertically extending support 368. The first shoulder stretching device 380 is positioned at an angle to the user's body when the user faces the rear vertical support member 370. That is, the first shoulder stretching device 380 is generally parallel to the upper horizontally extending support 365. The first shoulder stretching device 380 includes an upper horizontally extending frame portion 384 and an opposing lower horizontally extending frame portion 385. A plurality of vertically extending grasping bars 386 extend from the upper horizontal portion 384 to the lower horizontal portion 386.

A second shoulder stretching device 390 is positioned in opposed relationship to the first shoulder stretching device 380. The second shoulder stretching device 390 is generally mounted at a midportion of the vertically supporting member 366. The second shoulder stretching device 390 is positioned at an angle to the user's body when the user faces the rear vertical support member 370. That is, the second shoulder stretching device 390 is positioned in a generally parallel relationship to the upper horizontally extending support 364. The second shoulder stretching device 390 includes an upper horizontally extending portion 394 and a lower horizontally extending portion 395. A plurality of vertically extending grasping bars 396 extend from the upper horizontal portion 394 to the lower horizontal portion 395.

The user faces the rear vertical support member 370 such that his shoulders are generally between the first and second shoulder stretching devices 380 and 390. The user reaches over his right shoulder with both hands as if to perform a back swing for a right handed golfer, while keeping his head down, to grasp one of the vertically extending bars 396 of the second shoulder stretching device 390. As the user stretches, the user moves his hands to an adjacent bar 396 in a rearward fashion away from his body in a direction away from the rear vertical support 370. As the user continues to stretch, the user increases an arc and continues to moves his hands progressively from bars 396*a–f* which are respectively spaced further from the vertical support member 370. The user then continues this exercise by reaching over his left shoulder with both hands as if to perform a follow-through for a right handed golfer, to grasp one of the vertically extending bars 386 of the first shoulder stretching device 380. As the stretch progresses, the user again sequentially moves his hands along the bars 386*a–f* in a rearward direction away from the vertical support member 370 to increase his stretch and increase an arc of the follow-through swing.

Figure 21:
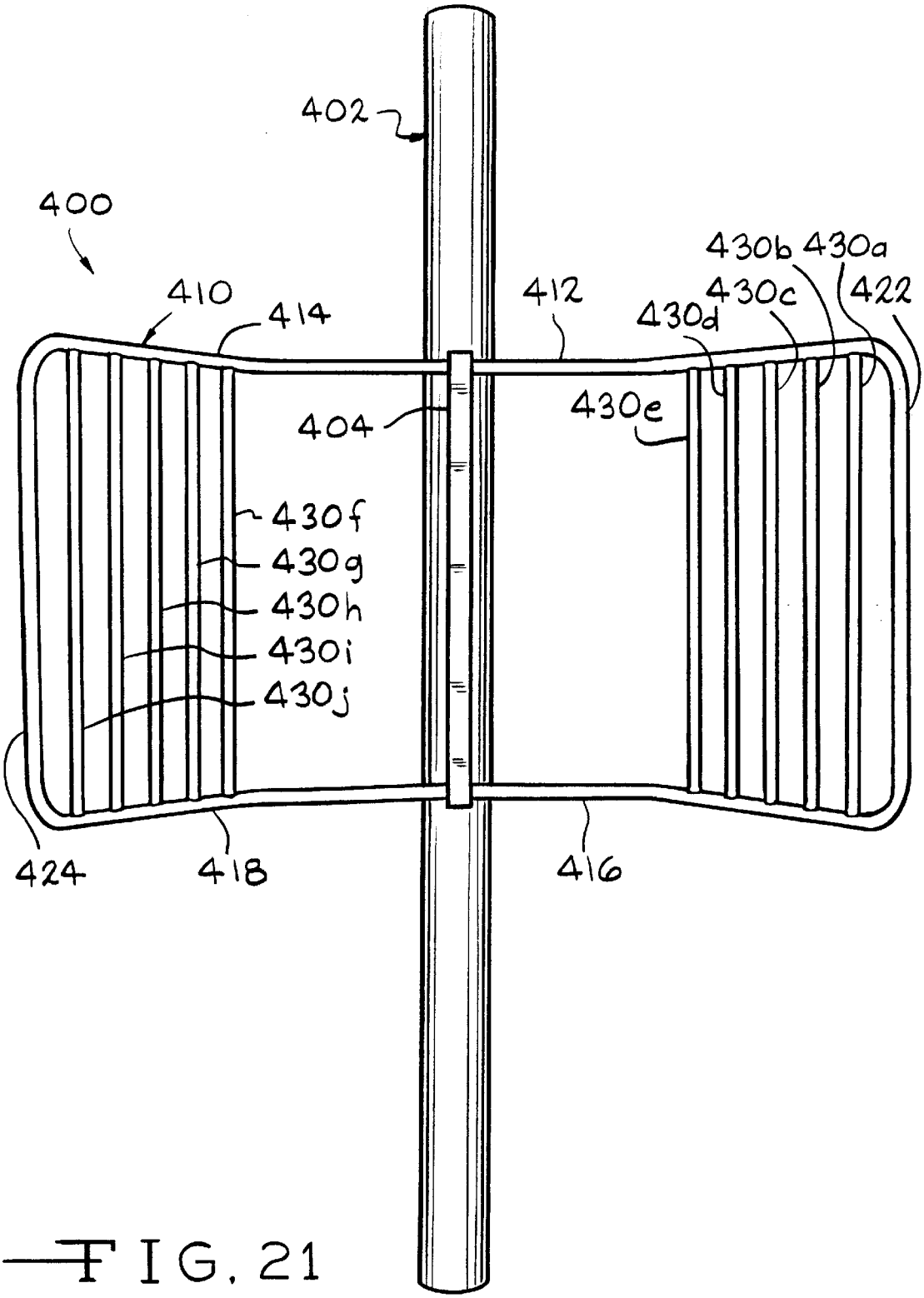
FIG. 21 is a perspective view of an alternative embodiment of a fifth exercise station.

FIG. 21 shows an alternative embodiment of a fifth exercise station 400. The fifth exercise station 400 is operatively mounted on a vertical support member 402. A shoulder stretching device 410 is operatively mounted to the vertical support member 402 by a horizontally extending bracket 404. The shoulder stretching device 410 includes a first upper horizontally extending portion 412 and a second upper horizontally extending portion 414 which extend from the vertical support member 402 in a curved or radial direction away from the support member 402. The shoulder stretching device 410 includes a first lower extending portion 416 and a second lower extending portion 418 which extend from the vertical support member 402 in a curved or radial direction away from the vertical support member 402. The first upper horizontally extending portion 412 and the first lower horizontally extending section 416 are operatively connected by a first vertically extending portion 422. The second upper horizontally extending portion 414 and the second lower horizontally extending portion 418 are operatively connected by a second vertically extending member 424. The shoulder stretching device 410 includes a plurality of vertically extending bars 430. In the embodiment shown, one set of horizontally extending bars 430*a*–430*e* is adjacent the first vertically extending portion 422 while an opposing set of horizontally extending bars 430*f*–430*j* is positioned adjacent the second vertically extending portion 424. However, it should be understood that it is within the contemplated scope of the present invention that additional vertical bars can extend throughout the radii defined by the curved portions 412, 414, 416 and 418.

The user stands facing the vertical support 402 and reaches both hands to grasp a bar 430*e* in a golf swing such that the left hand is lower than the right hand. The user continues to stretch reaching for sequential bars 430*d*, 430*c* and so on. The user then stretches to complete the stretch and exercise the muscles needed in a follow-through by grasping bars 430*f* through 430*j* as previously described with respect to FIGS. 18–20.

Figures 22, 23, 24:
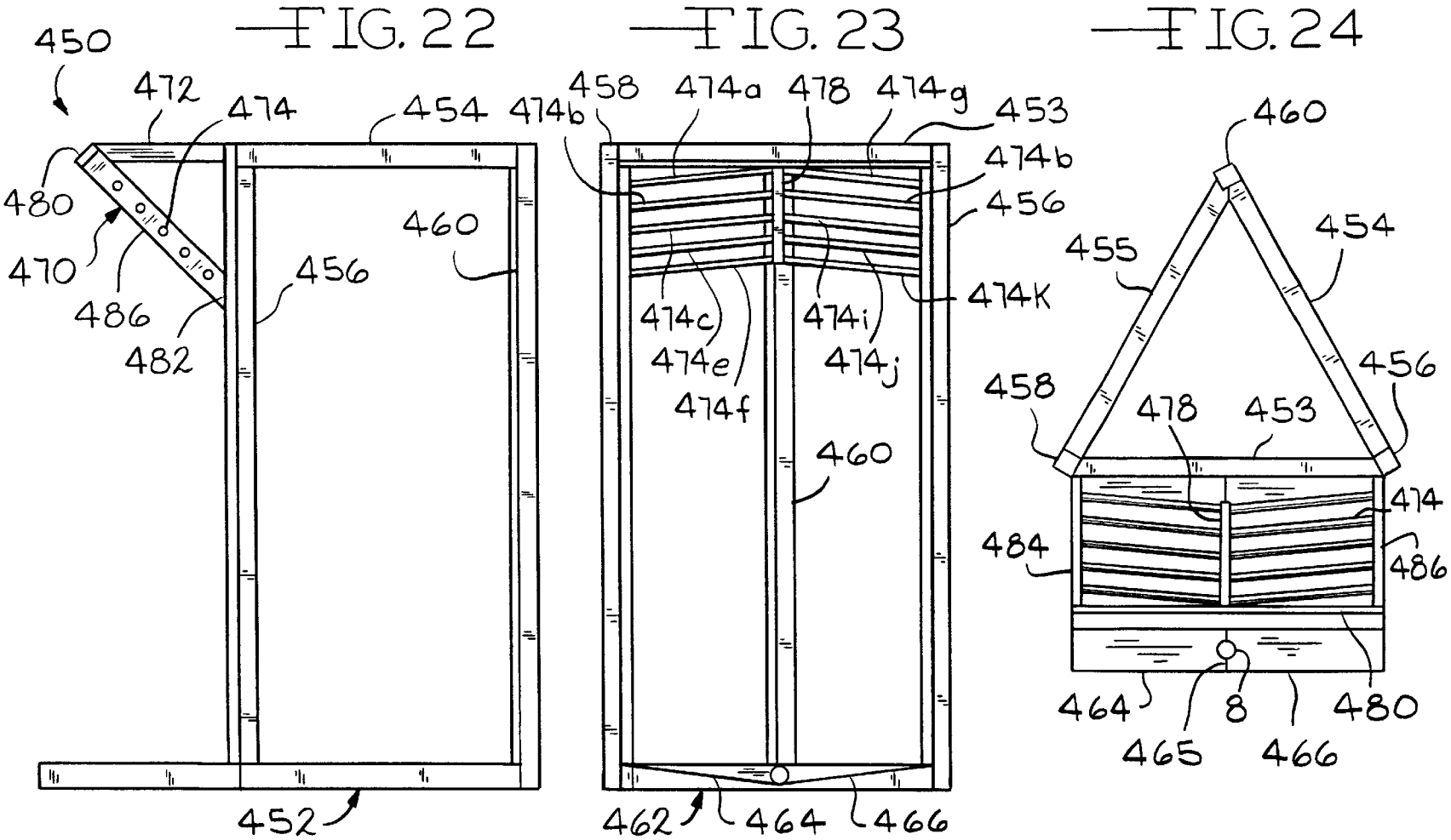
FIG. 22 is a side elevation view of one embodiment of a sixth exercise station.
FIG. 23 is a front elevation view of the exercise sixth station shown in FIG. 22.
FIG. 24 is a plan view of the sixth exercise station shown in FIGS. 22 and 23.

FIGS. 22, 23 and 24 show a sixth exercise station 450 which provides stretch for a full back swing and full follow-through. A frame 452 has opposed horizontally extending side support members 453, 454 and 455 which provide similar support as the side support members described in earlier Figures. The side support members 453, 454 and 455 are operatively connected to vertically extending support members 456, 458 and 460 to support the sixth exercise station 450.

Optimum stretching occurs when the user is standing on a support platform 462 as previously described. The support platform 462 includes a first angled mat 464 and second angled mat 466 which slope upwardly at an angle from about 4° to about a 8°, preferably at about 6°, from a midline 465.

The sixth exercise station 450 includes an overhead stretching device 470 that extends in a direction away from the support members 456 and 458 on at least one support bracket 472. The overhead stretching device 470 comprises a plurality of angled grasping bars 474. The angled grasping bars 474 are angled at desired angle from a plane defined by a rearward extending middle portion 478.

The angled grasping bars 474 are spaced between a front upper portion 480 and a rear lower portion 482. One set of bars 474*a*–474*f* extends from the middle portion 478 and terminates at a first side support 484. A second set of bars 474*g*–474*k* extends from the middle portion 478 and terminates at a second side support 486. The bars 474 are preferably evenly spaced apart. The bars angle from the center portion 478 in a forward and slightly downward direction to side support members 484 and 486.

In a preferred embodiment, the bars 474 slope at a downward angle, which is preferably about 15° from a horizontal plane through the middle portion 478. The 15° represents an ideal angle at which the golf club should be held when swinging.

The user stands on the platform 462 with his back to the rear vertical support member 460. The user reaches with both hands over his right shoulder to grasp one of the bars 474*a*–474*f* of the overhead stretching device 470. The user then stretches keeping his head down as if addressing a golf ball. The user then stretches by placing his hands over his left shoulder and grasping the angled bars 474*g*–474*k* to ensure a full stretch for the follow-through of a golf swing.

Figure 25:
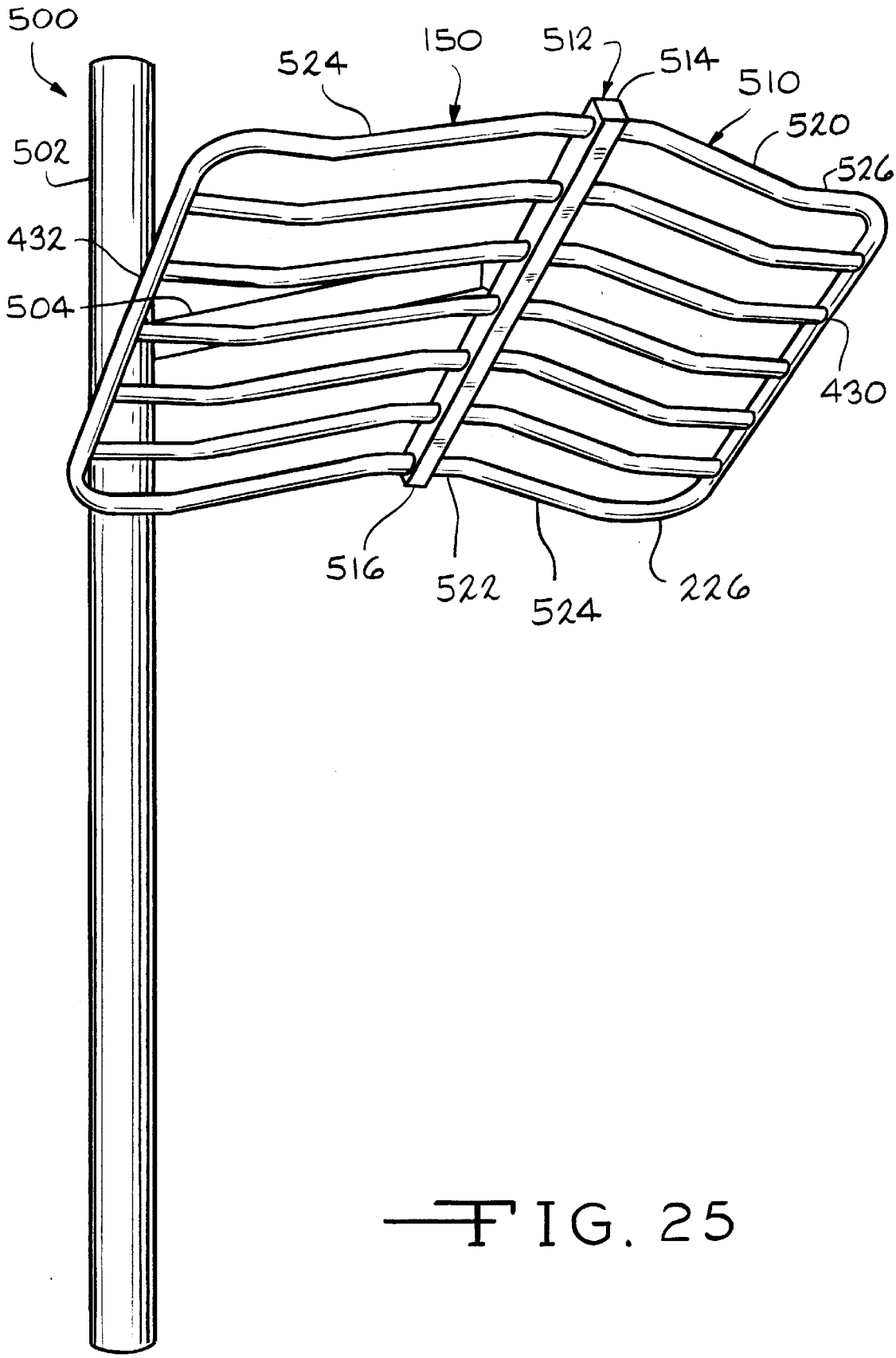
FIG. 25 is a perspective view of an alternative embodiment of a sixth exercise station.

FIG. 25 shows an alternative embodiment of a sixth exercise station 500. The sixth exercise station 500 is operatively mounted on a vertical support member 502. An overhead stretching device 510 is operatively mounted to the vertical support 502 by a generally horizontally extending bracket 504.

The overhead stretching device 510 comprises a center portion 512 which is operatively mounted at an angle to the bracket 504. The center support 512 is positioned at an angle to the support member 502. The center portion 512 has a first or upper end 514 which is spaced apart a first distance from the vertical support member 502 and a second or lower end 516 which is spaced apart a second and shorter distance from the vertical support member 502. The center support 512 thus extends at a rearwardly sloping angle. The overhead stretching device 510 includes a plurality of generally angled grasping bars 520. Each grasping bar 520 has a first portion 522 which generally extends in a perpendicular direction from the center support 512. Each grasping bar 520 has a center portion 524 which extends at about a 15° angle from the first section 522. Each grasping bar 520 can have a third portion 526 which extends from the center portion 524 in a direction that is generally parallel direction to the first portion 522. The third portions 526 terminate at generally vertically extending members 430 or 432.

The user stands with his back to the vertical support member 502 and reaches overhead to grasp the center portion 524 one of the bars 520. The 15° angled position of the center portion 524 ensures that the user places his shoulders and hands in a correct position to accomplish a reasonable golf swing. The stretching is accomplished in the manner previously described with respect to FIGS. 23–25.

Figure 26:
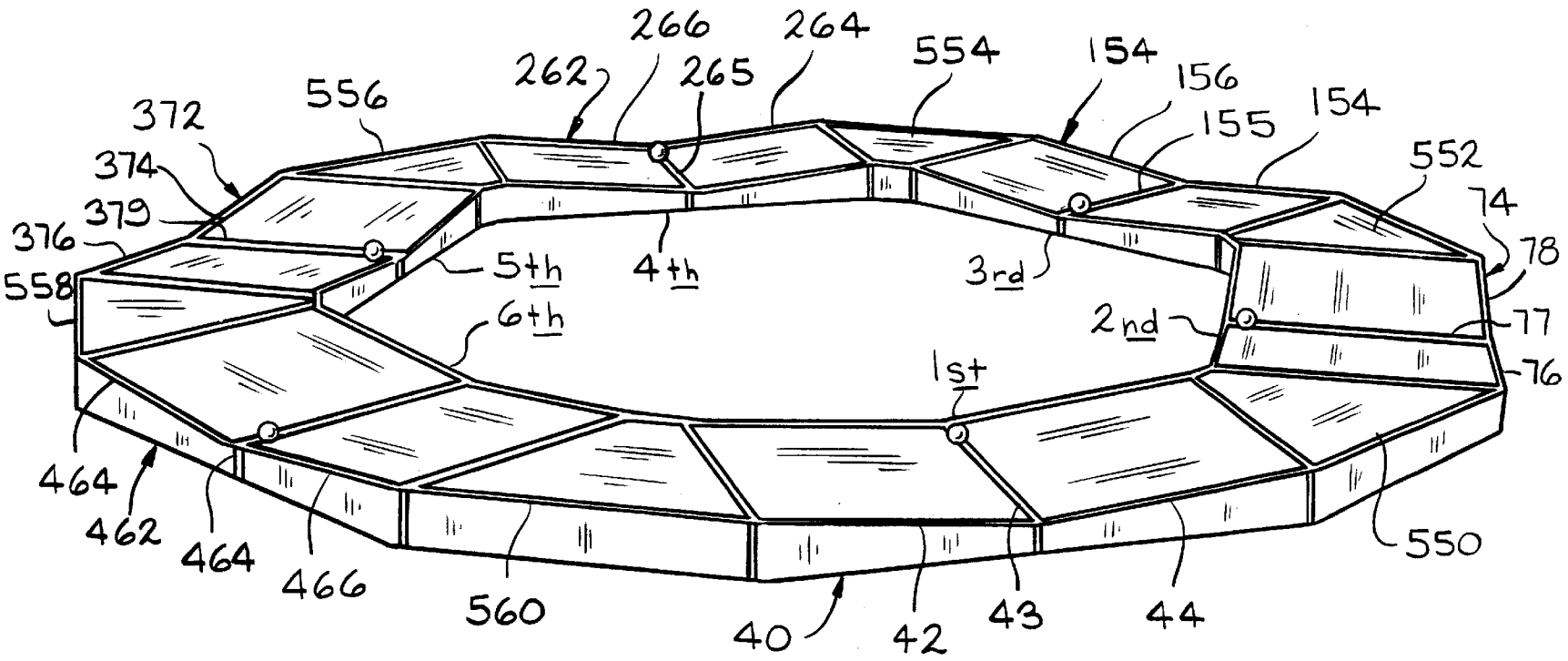
FIG. 26 is a perspective view of a support platform which can be included as part of the multiple station exercise apparatus.

FIG. 26 is a perspective view of a preferred embodiment of support platforms 40, 74, 154, 262, 372 and 462 joined together. The platforms can be joined together such that a plurality of connecting platforms 550, 552, 554, 556, 558 and 560 can be positioned between adjacent stations. While not shown in the Figures, it is within the contemplated scope of the present invention that display and/or instructional information can be operatively positioned on the connecting platforms.

Figure 27:
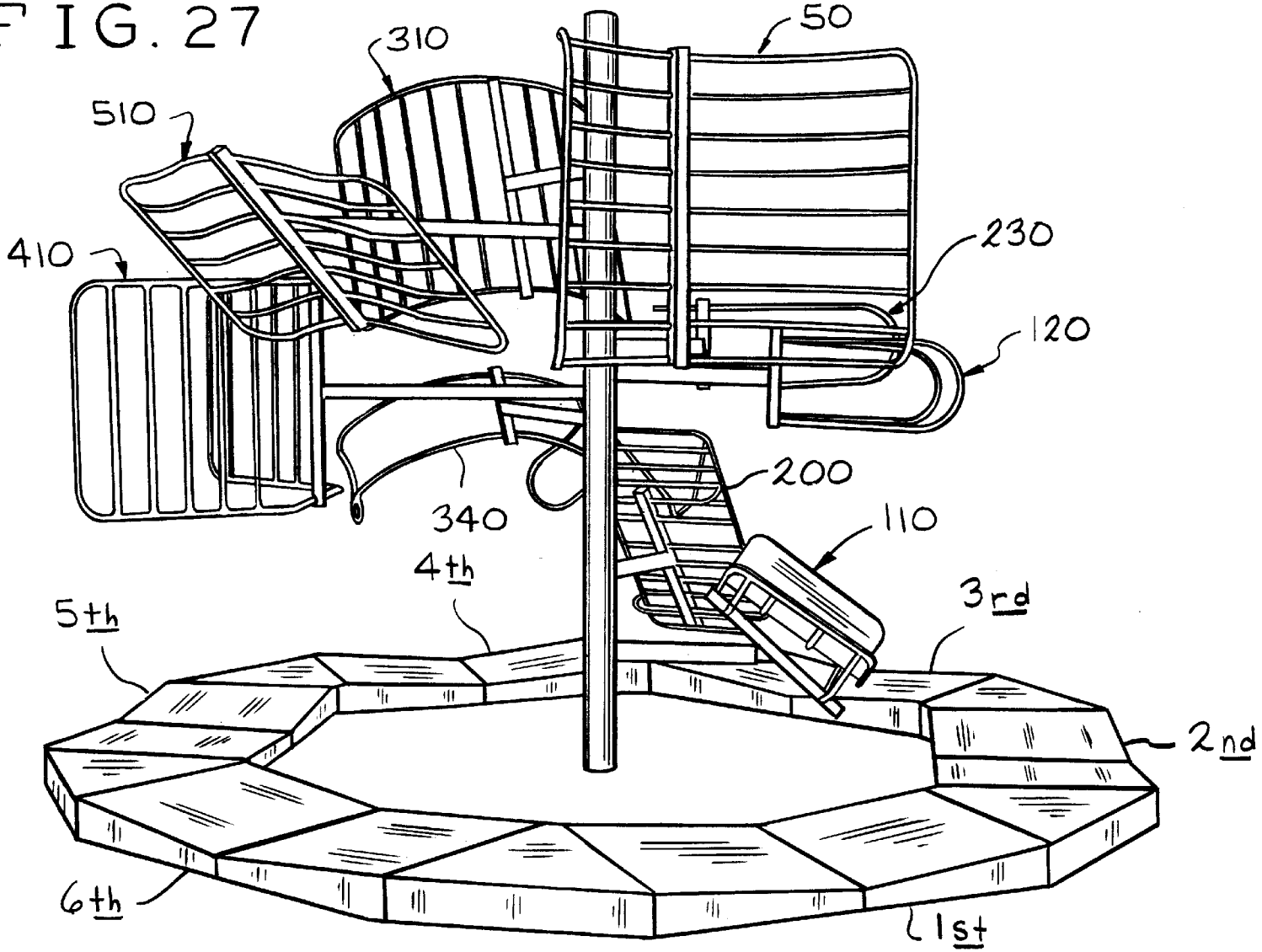
FIG. 27 is a perspective view of one embodiment of a multiple station exercise apparatus showing six exercise stations.

FIG. 27 shows a perspective view of the alternative embodiment of the present invention showing six stations adjoined to a single vertical support. While the stations are shown in a generally circular manner such that the multiple exercise station apparatus of the present invention can take up a small amount of space, it is also within the contemplated scope of the present invention that the stations can be laid out in a sequential direction moving left to right or right to left so that the user can proceed from station to station in the desired sequence to achieve the maximum stretching benefit.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A multiple station exercise and stretching apparatus comprising a first exercise device having a plurality of spaced apart horizontal bars;

a second exercise device having a foot support which includes a generally planar middle support portion, a first side angled support portion which is positioned at an acute angle to a horizontal plane defined by the middle support portion, and a second side angled support portion which is positioned at an opposing acute angle to the horizontal plane defined by the middle support portion; the second exercise device further including at least one horizontally extending grasping bar which is in a spaced apart relationship to the foot support;

a third exercise device having at least one foot stirrup for supporting a foot, the third exercise station further including at least one horizontally extending bar which is in a spaced apart relationship to the foot stirrup;

a fourth exercise device having an upper grasping member comprised of a plurality of spaced part angled bars which are positioned at an acute angle with respect to a vertical plane defined by a support, each angled bar having first ends which are mounted at a first distance from the support and second ends which are mounted at a second and shorter distance from the support, the fourth exercise device further having at least one lower grasping member which is position at an acute angle to the upper grasping member;

a fifth exercise device having a plurality of spaced apart vertically extending bars; and, a sixth exercise device having an overhead stretching member comprised of a plurality of spaced apart angled overhead bars mounted on at least one center support member, the angled bars being positioned at an acute angle with respect to the center support member, the center support member having a first end spaced at a first distance from a vertical support member and second end being spaced at a second and shorter distance than the first end of the center support, the overhead bars being mounted on the vertical support member and being positioned at an acute angle to the vertical support member, wherein at least one of the first, second, third, fourth, fifth and/or sixth exercise devices are operatively connected to at least one adjacent first, second, third, fourth, fifth and/or sixth exercise devices to allow a user to stretch the user's muscles in a progressive manner by moving from one exercise device to the adjacent exercise device.

2. The apparatus of claim 1, wherein at least one of the first, second, third, fourth, fifth and sixth devices are adjacent a support platform having a first angled mat which angles upwardly at an acute angle from a horizontally positioned midline and a second angled mat which angles at an acute angle upwardly in an opposite direction from the first angled mat.

3. The apparatus of claim 1, wherein the first station further includes at least one pair of vertically extending grasping bars positioned in a spaced apart relationship to the horizontal bars.

4. The apparatus of claim 1, wherein the horizontal bars of the first exercise device curve in a direction away from a vertically extending support member.

5. The apparatus of claim 1, wherein the third exercise device comprises a plurality of foot stirrups.

6. The apparatus of claim 1, wherein the lower grasping member of the fourth exercise device includes two sets of opposed lower grasping bars, the first set of lower grasping bars being positioned at an acute angle facing the upper grasping member, the second set of grasping bars being positioned at an acute angle facing the upper grasping member, the first and second set of grasping bars being positioned at an acute angle to each other.

7. The exercise apparatus of claim 1, wherein the lower grasping member of the fourth exercise device comprises a generally horizontally positioned arcuate member which extends in a radial direction away from the vertical support.

8. The exercise apparatus of claim 1, wherein the fifth exercise device comprises a first set of the vertical bars adjacent a first vertical support member and a second set of the vertical bars adjacent a second vertical support member, the first and second sets of the vertical bars being positioned at an acute angle with respect to each other.

9. The exercise apparatus of claim 1, wherein the vertical bars of the fifth exercise device are positioned on at least one horizontal bar which extends in a curved direction away from a vertical support member.

10. The exercise apparatus of claim 1, wherein angled overhead bars of the sixth exercise device extend at an angle of about 15° from the center support member.

* * * * *